US007581672B1

(12) United States Patent
Keefe

(10) Patent No.: US 7,581,672 B1
(45) Date of Patent: Sep. 1, 2009

(54) CONTAINER

(75) Inventor: Walter A Keefe, Carol Stream, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/147,219

(22) Filed: Jun. 26, 2008

(51) Int. Cl.
*B65D 5/18* (2006.01)

(52) U.S. Cl. ..... 229/109; 229/164; 229/167; 229/170; 229/173

(58) Field of Classification Search ..... 229/109, 229/164, 167, 170, 173, 176, 178
See application file for complete search history.

(56) References Cited

U.S. PATENT DOCUMENTS 2,350,262 A * 5/1944 Van Rosen ..... 229/167
2,781,160 A * 2/1957 Bolding ..... 229/167
2,838,221 A * 6/1958 Wilson ..... 229/178
2,845,211 A * 7/1958 Hauck et al. ..... 229/178
2,963,211 A * 12/1960 Agler ..... 229/167
3,014,633 A * 12/1961 Tarmina ..... 229/178
3,305,078 A * 2/1967 Ferrera ..... 229/164
3,924,801 A * 12/1975 Partain ..... 229/178
4,116,330 A * 9/1978 Ellis ..... 229/164
4,372,476 A * 2/1983 Harned et al. ..... 229/178
4,792,084 A * 12/1988 Dreeszen ..... 229/109
4,896,825 A * 1/1990 Moeller ..... 229/167
5,295,623 A * 3/1994 Bacques et al. ..... 229/109
6,045,038 A * 4/2000 Smith et al. ..... 229/167
2007/0228119 A1* 10/2007 Barner ..... 229/109
2008/0078821 A1 4/2008 Keefe et al.

FOREIGN PATENT DOCUMENTS

FR 2677956 A1 * 12/1992 ..... 229/109

* cited by examiner

*Primary Examiner*—Gary E Elkins

(57) ABSTRACT

A container formed of spaced apart outer and inner back panels, and spaced apart outer and inner side panels, outer and inner front panels and outer and inner bottom panels. The outer bottom panel is octagonal. Corner panels extend between the outer back panel and outer side panels and between the outer side panels and the outer front panels. The container structure functions to prevent telescoping of vertically stacked container and for strength and stability. The container may be partially assembled for shipping and hand set into final assembly as needed.

2 Claims, 3 Drawing Sheets

CONTAINER

This application relates to a container which is easily stackable, has beveled corners which allows easier placement on shelves and enhanced graphic appeal and has square interior corners.

DETAILED DESCRIPTION

Figure 1:
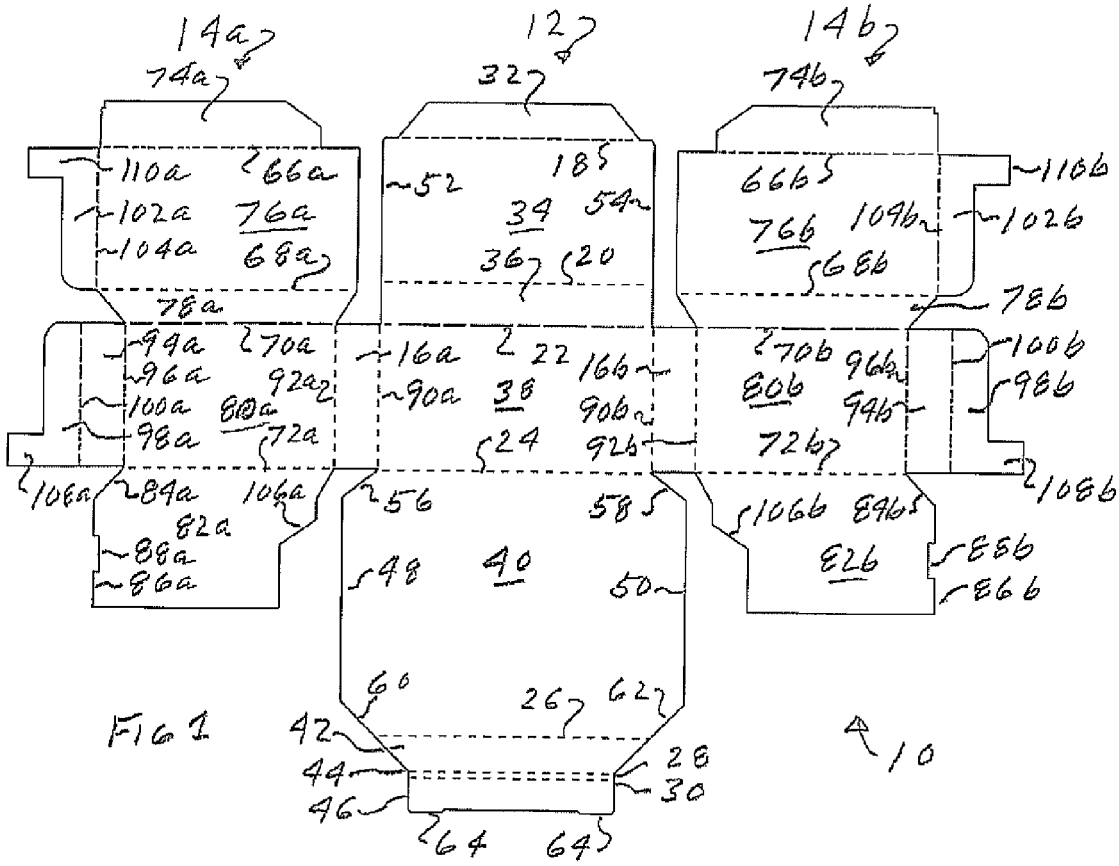
FIG. 1 is a top plan view of a blank for the container.
Figure 2:
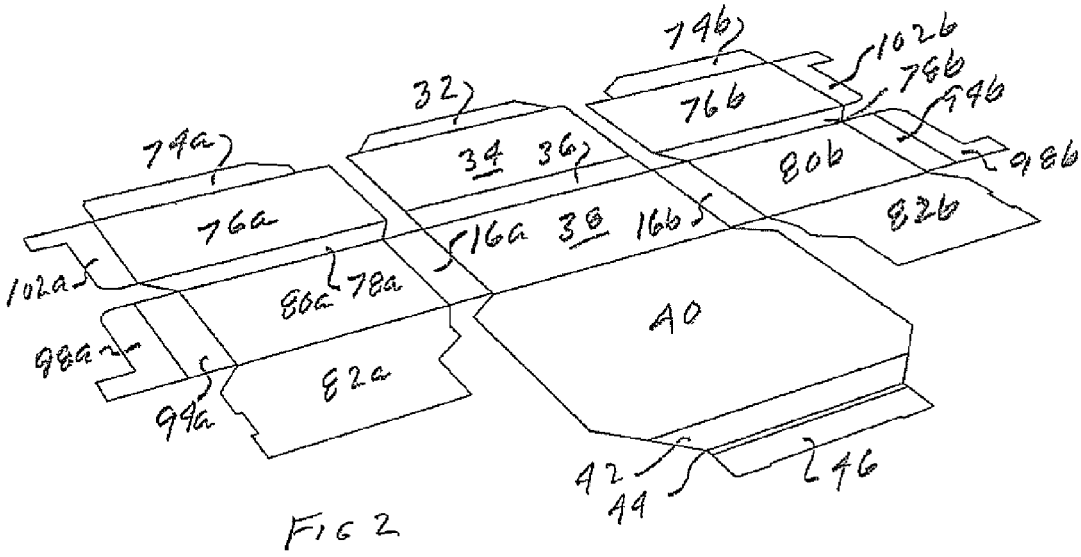
FIG. 2 is an isometric view of the blank
Figure 3:
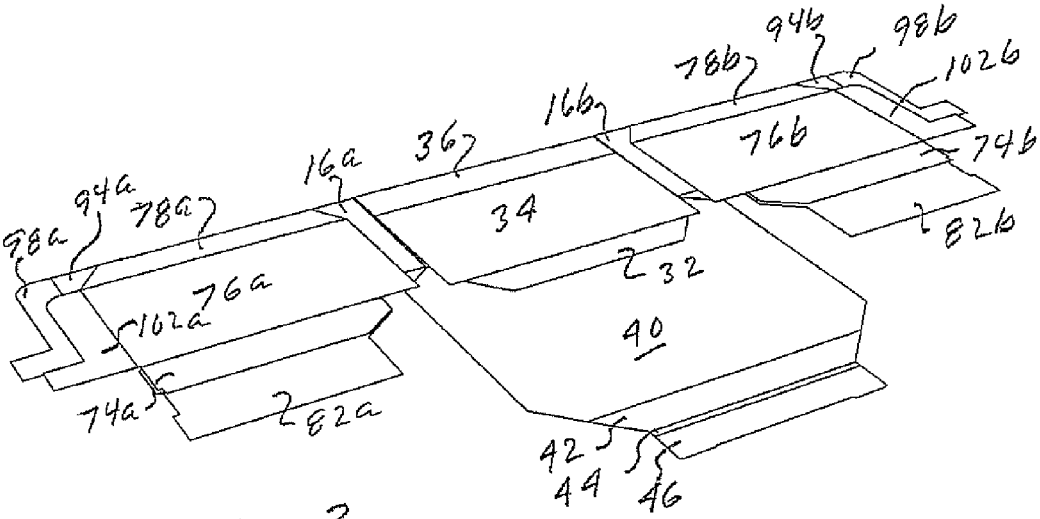
FIGS. 3-5 are isometric views showing the formation of the container.
Figure 4:
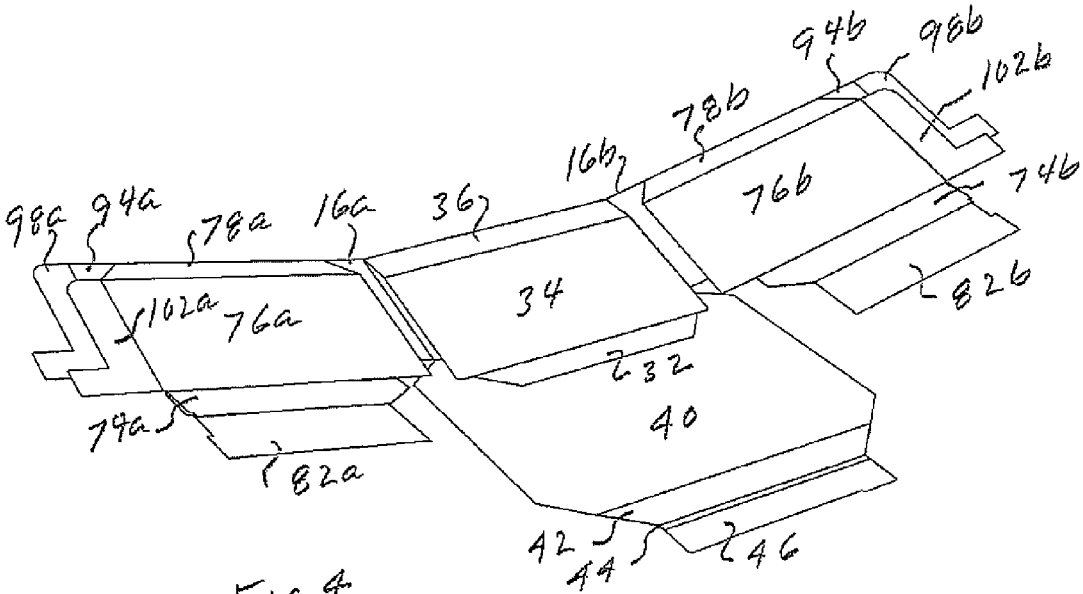
Figure 5:
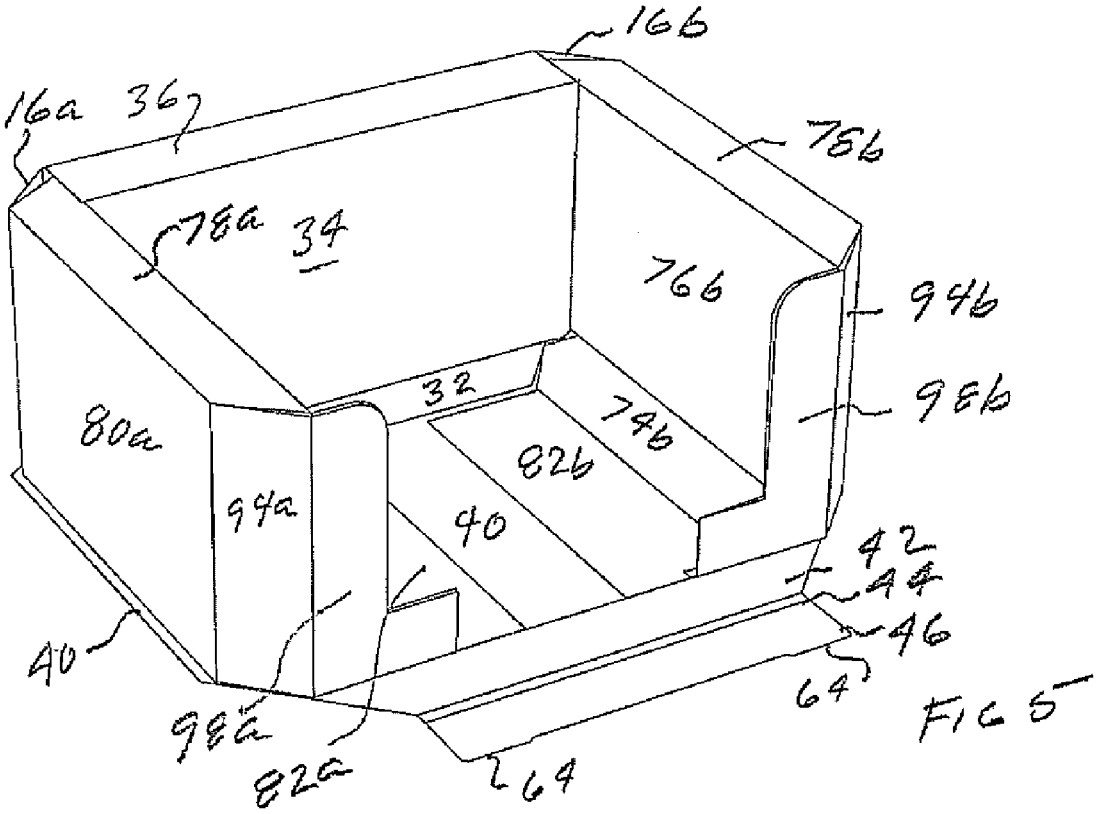
Figure 6:
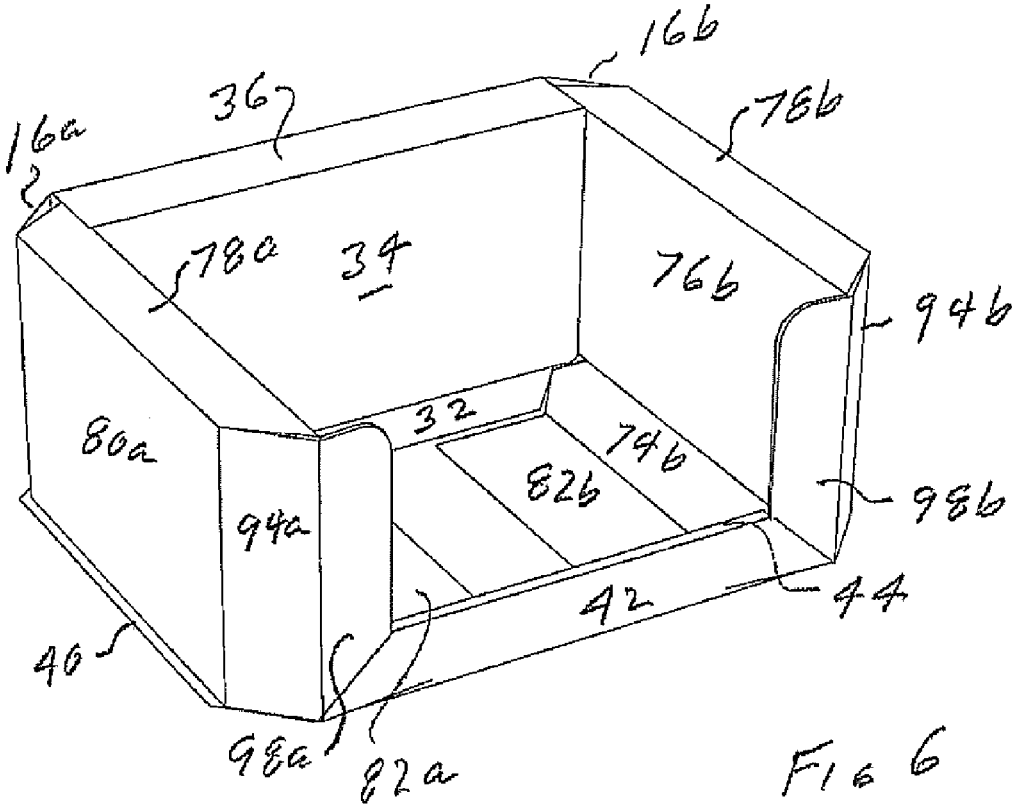
FIG. 6 is an isometric view of the container.

Throughout the application the term attachment line is used. An attachment line can be a score line, a reverse score line, a slit and score line or a perforation line depending on the use of the line and its direction of rotation.

The blank 10 is formed of a central section 12 attached to two side sections 14*a* and 14*b* by rear outer corner panels 16*a* and 16*b*. The sections 12 and 14 are otherwise separated.

The central section 12 is divided by parallel longitudinal attachment lines 18, 20, 22, 24, 26, 28 and 30 into a back attachment panel 32, an interior back panel 34, an upper back panel 36, an outer back panel 38, an outer bottom panel 40, an outer front panel 42, an upper front panel 44 and an inner front panel 46.

The outer bottom panel 40 is octagonal is shape and is wider between its side edges 48 and 50 than the interior back panel 34, the rear upper panel 36 and the outer back panel 38 are between their side edges 52 and 54. The outer bottom panel 40 has back corner edges 56 and 58 extending between its back edge, defined by attachment line 24, and its side edges 48 and 50, respectively. The outer bottom panel 40 also has front corner edges 60 and 62 extending between its front edge, defined by attachment line 26, and its side edges 48 and 50, respectively.

The inner front panel 48 has locking tabs 64 on its outer edge.

Each of the side sections 14 are the same and like reference numerals will be used. Each of the side sections is divided by parallel longitudinal attachment lines 66, 68, 70 and 72 into a side attachment panel 74, an inner side panel 76, an upper side panel 78, an outer side panel 80 and an inner bottom panel 82.

The inner bottom panel 82 has a front corner 84 that aligns with the corresponding front corner edge 60 or 62 of the outer bottom panel 40 in the formed container. The front edge 86 of the inner bottom panel 82 has locking indents 88 which align with the locking tabs 64 of the inner front panel 48 in the formed container.

The rear outer corner panels 16 are connected to the side of outer back panel 38 along transverse attachment lines 90 and are connected to the back side of each of the outer side panels 80 along transverse attachment lines 92. Attachment lines 90 and 92 are parallel.

A front outer corner panel 94 is attached to the front side edge of outer side panel 80 by transverse attachment line 96. An outer L-shaped front side panel 98 is attached to the front outer corner panel 94 by a transverse attachment line 100. An inner L shaped front side panel 102 is attached to the front side of the inner side panel 76 by transverse attachment line 104.

The container is formed by folding the upper back panel 36 and its associated inner back panel 34 and back attachment panel 32 inwardly around attachment line 22 and securing back attachment panel 32 to outer bottom panel 40. The attachment line 18 will be spaced from attachment line 24 the same distance that attachment line 20 is spaced from attachment line 22. Also both upper side panels 78 and their associated inner side panels 76 and side attachment panels 74 are folded inwardly around attachment lines 70 and side attachment panels 74 are secured to their respective outer side panels 80. The attachment lines 66 will be spaced from attachment lines 72 the same distance that attachment lines 68 are spaced from attachment lines 70. The securement of the attachment panels can be by glue or staple. This step can be at the container plant.

The outer bottom panel is bent upwardly around attachment line 24 and the inner bottom panels 82 are bent upwardly around attachment lines 72. The attachment lines 72 are offset slightly from attachment line 24 to allow the inner bottom panels 82 to slide in over the outer bottom panel 40 when the container is set up.

The movement of the outer bottom panel 40 and 72 causes the inner, top and outer back walls 34, 36 and 38 to rotate around their attachment lines 18, 20 and 22 to form the back wall with the inner back panel spaced from the outer back panel. The movement of the inner bottom panels 82 causes the inner, top and outer side walls to rotate around their attachment lines 66, 68 and 70 to form the side walls with the inner side panels spaced from the outer side panels.

The back corner panels 16 are bent inwardly around attachment lines 90 until the corner panels align with the back corner edges 56 and 58 of the outer bottom panel 40. The outer side panels 80 are bent inwardly around attachment lines 92 until the attachment lines 72 are aligned with the side edges 48 and 50 of the outer bottom panel 40. The inner bottom panels 82 slide over the outer bottom panel 40. The rear edges 106 of the inner bottom panels 82 are contoured to fit around the back attachment panel 32.

The front corner panels 94 are bent inwardly around attachment lines 96 until the corner panels align with the front corner edges 60 and 62 of the outer bottom panel 40. The inner L-shaped front side panels 102 are bent inwardly around attachment lines 104 and the outer L-shaped front side panels 98 are bent inwardly around attachment lines 100 until the panels are aligned with front edge 26 of the outer bottom panel and the panels are contiguous.

The outer front panel 42 is bent upwardly around attachment line 26, the upper front panel 44 is bent around attachment line 28 over the lower sections 108 and 110 of the L-shaped panels 98 and 102 respectively, and the inner front panel 46 is bent downwardly around attachment line 30. The tabs 64 are fitted into the locking indents 88 to lock the container walls in place.

The outer dimensions of the outer back panel, back corner panels, outer side panels and front corner panels correspond respectively to the outer bottom panel 40 back edge, back corner edges 56 and 58, side edges 48 and 50 and front corner edges 60 and 62. The back edge of outer bottom panel 40 is attachment line 24 and the front edge of outer bottom panel 40 is attachment line 26.

The container has outer corner panels which makes it easy to slide the container into place between other containers on shelves and provides enhanced graphic appeal. The inner side walls 80 and inner back wall 34 meet to form an inner space that is rectangular in cross section allowing easier access to the product within the container. The upper side panels and upper back panel are aligned at the same height and provide a platform for stacking the containers. The spacing of the inner side walls from the outer side walls, and the inner back walls from the outer back walls allows the outer dimensions of the container to be constant from container to container for proper pallet sizing and shelf sizing while allowing the interior size of the container to be varied for different products. This is done by changing the dimensions of the top panels.

The container can be made from corrugated container board, container board, fiberboard or paperboard.

It will be appreciated that other modifications may be made to the container without departing from the spirit of the invention.

The invention claimed is:

1. A container blank comprising a central section divided by longitudinal attachment lines to define a back attachment panel, an inside back panel, a top back panel, an outside back panel, an outside bottom panel, an outside front panel, a top front panel and an inside front panel, a pair of side sections, each divided by longitudinal attachment lines to define a side attachment panel, an inner side panel, a top side panel, an outer side panel, and an inner bottom panel, a first back corner panel having a first side attached to a first side of the outer back panel by an attachment line and having a second side, opposed to the first back corner panel first side, attached to a first side of one of the outer side panels, a second back corner panel having a first side attached to a second side of the outer back panel by an attachment line and having a second side, opposed to the second back corner panel first side, attached to a first side of other of the outer side panels, a first front corner panel attached to a second side of the one outer side panel by an attachment line, a first front panel attached the side of the first front corner panel opposite the one outer side panel, a second front corner panel attached to a second side of the other outer side panel by an attachment line, a second front panel attached the side of the second front corner panel opposite the other outer side panel.

2. A container comprising an outer bottom panel having a back edge, back corner edges, side edges, front corner edges and a front edge, an outer back panel attached to and extending upwardly from the outer bottom panel, a top back panel attached to and extending inwardly from the outer back panel, an inner back panel attached to and extending downwardly from the top back panel, the inner back panel and the outer back panel being spaced apart, a back attachment panel attached to and extending inwardly from the inner back panel, the back attachment panel being secured to the outer bottom panel, the inner and outer back panels being spaced apart, the outer back panel having opposed sides, a first back corner panel having opposed sides, one side of the first back corner panel being attached to one of the outer back panel opposed sides and aligned with one of the outer bottom panel back corner edges, the other side of the first back corner panel being attached to one side of a first outer side panel, a second back corner panel having opposed sides, one side of the second back corner panel being attached to the other of the outer back panel opposed sides and aligned with the other of the outer bottom panel back corner edges, the other side of the second back corner panel being attached to one side of a second outer side panel, a first top side panel attached to and extending inwardly from said first outer side panel, a first inner side panel attached to and extending downwardly from the first top side panel, a first side attachment panel attached to and extending inwardly from the first inner side panel, the first side attachment panel being secured to the first inner bottom panel, the first inner and outer side panels being spaced apart, a second top side panel attached to and extending inwardly from the second outer side panel, a second inner side panel attached to and extending downwardly from the second top side panel, a second side attachment panel attached to and extending inwardly from the second inner side panel, the second side attachment panel being secured to the second inner bottom panel, the second inner and outer side panels being spaced apart, the first and second outer side panels each having opposed side edges, the one side edge of the outer side panels being one of the opposed edges, a first front corner panel attached to the other side edge of the first outer side panel, the first front corner panel being aligned with one of the front corner edges of the outer bottom panel, a first front panel attached to the first front corner panel, a second front corner panel attached to the other side edge of the second outer side panel, the second front corner panel being aligned with the other of the front corner edges of the outer bottom panel, a second front panel attached to the second front corner panel.

* * * * *